United States Patent [19]

Buck et al.

[11] 4,251,949

[45] Feb. 24, 1981

[54] TOY TRACK AND BOWL WITH CAR HEIGHT INDICATOR

[75] Inventors: Gordon H. Buck, Torrance; Kenneth I. Amamoto, Los Angeles; William Hart, Palos Verdes Estates; Michael T. McKittrick, Jr., Cerritos, all of Calif.

[73] Assignee: Mattel, Inc., Hawthorne, Calif.

[21] Appl. No.: 13,695

[22] Filed: Feb. 21, 1979

[51] Int. Cl.[3] ..... A63H 11/10; A63H 33/00; A63G 7/00

[52] U.S. Cl. ..... 46/202; 46/43; 46/1 K; 104/68

[58] Field of Search ..... 46/201, 202, 206, 43, 46/1 K; 272/46; 104/56, 63, 68

[56] References Cited

U.S. PATENT DOCUMENTS

| | | | |
|---|---|---|---|
| 788,980 | 5/1905 | Wolmouth | 46/44 |
| 1,191,477 | 7/1916 | Rumke | 104/68 |
| 2,000,808 | 5/1935 | Williams | 46/43 |
| 2,080,029 | 5/1937 | Bartlett | 104/68 |
| 3,167,024 | 1/1965 | Bacon et al. | 104/63 |
| 3,343,793 | 9/1967 | Waser | 46/43 UX |
| 3,352,251 | 11/1967 | Einfalt | 104/63 |
| 3,665,636 | 5/1972 | Benson et al. | 46/1 K |
| 3,686,789 | 8/1972 | Polonyi | 46/43 |

*Primary Examiner*—Gene Mancene
*Assistant Examiner*—Michael J. Foycik, Jr.

[57] ABSTRACT

A toy racing apparatus including an inclined section of track and a bowl. The track enters the bowl through an opening in the lower sidewall where its surface is tangent to the interior wall. A vehicle placed at the upper end of the track will speed down the track, enter the bowl, and progress in a spiral path upwardly inside the bowl. In a preferred embodiment, the bowl is transparent and flags are positioned to be displaced as a vehicle reaches particular heights in the bowl.

1 Claim, 3 Drawing Figures

TOY TRACK AND BOWL WITH CAR HEIGHT INDICATOR

BACKGROUND OF THE INVENTION

The background of the invention will be discussed in two parts:

1. Field of the Invention

This invention relates to toys and, more particularly, to racing tracks for toy automobiles.

2. Description of the Prior Art

There have been a myriad of toys developed over the years for use by children of all ages. Many of these toys have become classics and have been reproduced again and again. Those toys which have lasted have certain common characteristics. First, they provide a substantial amount of excitement for the child. Second, they are well made and durable so that the child may play with them over a long period of time. Next, they are sufficiently inexpensive so that they appeal to a broad market. Finally, and especially more recently, such toys are safe to use. Meeting all of these criteria has posed a substantial problem for many prior art toys.

A popular type of toy is a gravity powered vehicle which moves down an inclined track, gaining substantial speed, and negotiates some form of racing track layout. Often, a pair of gravity powered vehicles are raced on adjacent tracks to heighten the excitement of the toy with competition. Such arrangements can be quite exciting, but the excitement generated often waxes after a short time. Furthermore, to obtain the optimum degree of excitement, the vehicles must hurtle down the inclined track portion at quite high speeds and may endanger those playing with the toys.

It is an object of the present invention to provide a new and exciting toy racing apparatus for use with gravity powered vehicles.

It is another object of the present invention to provide a toy racing apparatus for gravity powered vehicles which offers a new form of competition and added excitement.

It is another object of the present invention to provide an especially safe racing track layout for gravity powered toy vehicles.

SUMMARY OF THE INVENTION

The foregoing and other objects of the invention are accomplished by a toy racing apparatus which includes a first portion of steeply inclined track capable of imparting a substantial speed to a gravity powered vehicle placed thereon and a second portion which comprises, in a preferred embodiment, a frusto-conical bowl-like portion which increases in diameter from its base to its top. A gravity powered vehicle leaves the inclined track and enters the base of the frusto-conical portion at a high speed. The vehicle travels in a spiral path therein progressing from the base upwardly until it reaches it maximum height at which it falls back into the base of the frusto-conical portion. In the preferred embodiment, the frusto-conical portion may be constructed of a transparent material and have a series of racing flags to mark the particular heights reached by the vehicles to lend especial excitement to the operation of the toy. The frusto-conical portion confines the speeding vehicles within its interior so that even at maximum speed they cannot escape and harm those playing with the toy.

Other objects, features, and advantages of the invention will become apparent from a reading of the specification taken in conjunction with the drawings in which like reference numerals refer to like elements in the several views.

DESCRIPTION OF THE PREFERRED EMBODIMENT

Figure 1:
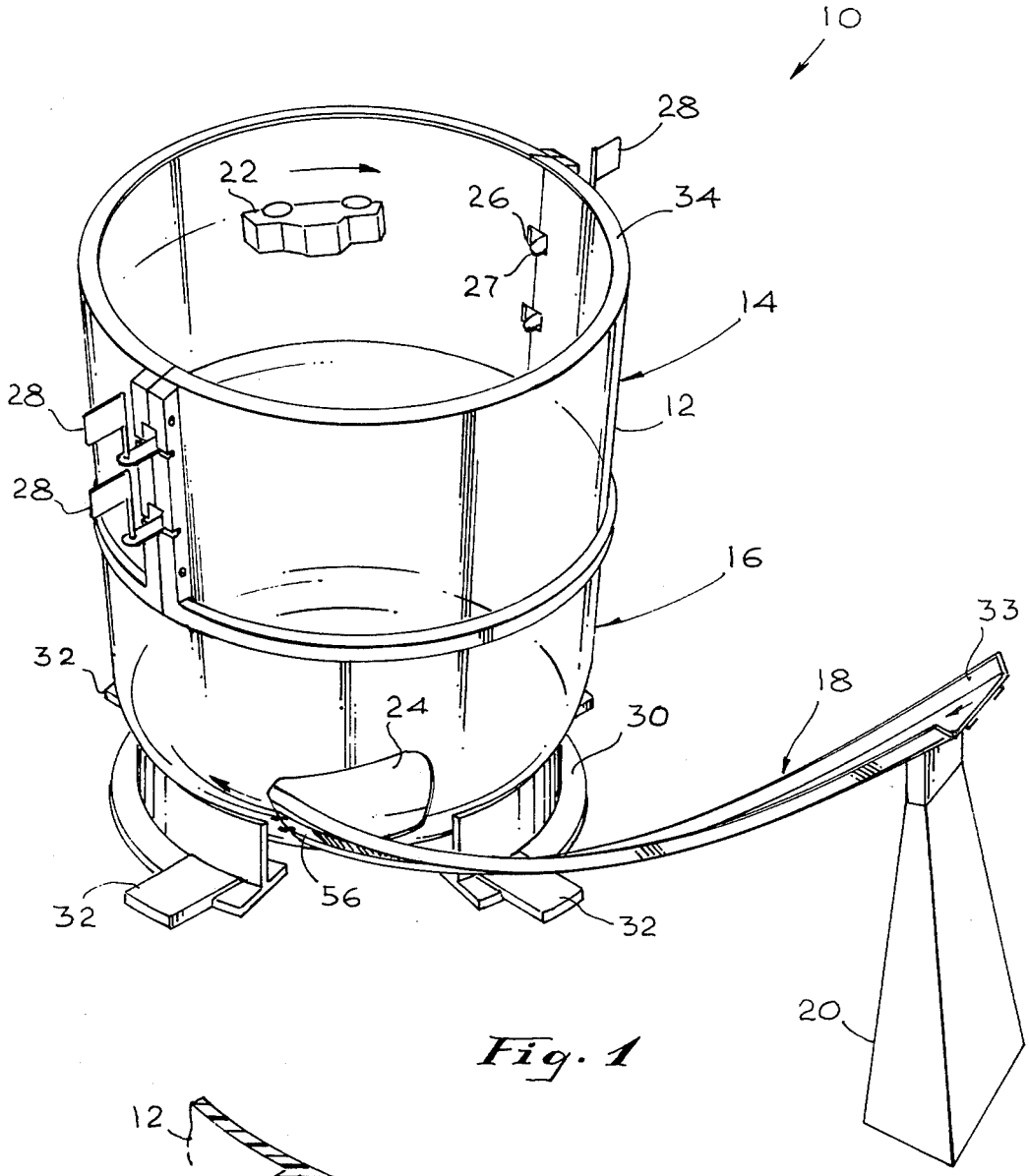
FIG. 1 is a perspective view of a toy racing track constructed in accordance with the invention.

Referring now to the drawings and, more particularly, to FIG. 1, there is shown a perspective view of a toy race track 10 constructed in accordance with the invention. The toy race track 10 includes a drum 12, having an upper section 14 and a lower section 16, and an inclined track 18 leading to the drum 12. The inclined track 18 may, in a preferred embodiment, be much longer than is shown in the drawing and may be constructed of a material such as a flexible plastic so that it may be selectively inclined at various angles to impart a desired speed to a vehicle 22 (shown within the drum 12). The track 18 is held in the inclined position by a support 20.

The drum 12 is essentially a right circular frusto-conical section having a closed bottom and an open top. The track 18 is affixed thereto so that the running surface of the track 18 enters the interior of the lower section 16 essentially tangent to the inside wall of the section 16 through an opening 24. Projecting into the interior of upper section 14 through openings 26 in the inner surface thereof are projection 27. The projections 27 are positioned in different heights above the base of the drum 12 and are each connected to a flag 28 or other indicator.

The lower section 16 of the drum 12 is supported by a base 30 which has four legs 32 projecting therefrom so that the drum 12 is securely supported in the upright position.

When the vehicle 22 is placed at the upper end of the inclined track 18 and released, it will proceed downwardly along the track 18 and enter the opening 24 in the wall of the lower section 16 at a high speed. The vehicle 22 will continue around the inner wall of the drum 12, its path describing in an upwardly progressing spiral, until it reaches its maximum height. This height will be determined to a great degree by the vehicle's entry speed into the drum 12 which depends on the length and the angle of incline of the track 18, and by the slope of the inner walls of the drum 12. As the vehicle 22 circles the inner walls of the drum 12, it will come in contact with various of the projections 27 connected to the flags 28 thereby causing each of the projections 27 to move the flags 28 (as will be explained hereinafter) to indicate the various heights reached by the vehicle. Consequently, different vehicles 22 may be raced down the inclined track 18 and round the interior of the drum 12 to reach different heights which will be marked by the racing flags 28. In a preferred embodiment, the upper and lower sections 14 and 16 of the drum 12 may be made of a transparent plastic material so that the spiraling action of the vehicles may be viewed by the children playing with the toy thereby heightening the excitement and play value of the toy.

The track 18 may be constructed as are any of a number of flexible tracks well known to the prior art and presently available on the commercial market. It should be especially noted that the track 18 is provided with an outer lip 33 which assures that a vehicle 22 progressing down the incline will be maintained within the boundaries of the track 18. A rim 34 is also provided at interior of the upper edge of the upper section 14 to contain any vehicle which might attempt to continue beyond that upper edge. Consequently, racing vehicles 22 may be operated at relatively high speeds yet will be confined within the interior of the drum 12 thereby essentially eliminating any danger to a child playing with the toy.

Figure 2:
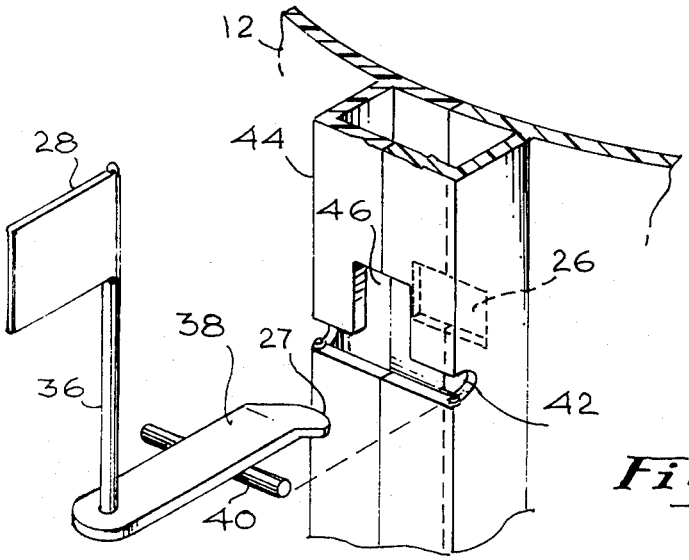
FIG. 2 is an enlarged detail illustrating the construction of the racing flags used with the invention shown in FIG. 1.

The details of the mechanization of the racing flags 28 are described in FIG. 2 which is an enlarged perspective of a portion of the invention shown in FIG. 1. The flag 28 is connected to a staff 36 which is affixed at right angles to a flat piece 38. The piece 38 terminates at its other end in the projection 27. The piece 38 is flat and lies essentially in one plane but hooks to the right at the projection 27 to provide for fastening around the edge of the interior opening 26 (shown in FIG. 1). The piece 38 is affixed at right angles to a circular bar 40. The circular bar 40 snaps into openings 42 in a reinforcing member 44. The openings 42 join a larger opening 46 in the outer surface of the member 44 which allows the projection 27 to be inserted through and into the openings 26 in the interior wall of the upper section 14. After insertion, the piece 38 is slid along the axis of the bar 40 to the right (as shown in FIG. 2) so that the projection 27 hooks over the edge of the opening 26 and maintains the flag 28 in an upright position.

When a vehicle 22 traveling inside the drum 12 comes in contact with a projection 27 it will drive the projection 27 to the left causing the bar 40 to move to the left on its axis thereby releasing the flag 28 so that it will rotate on bar 40, drop down, and indicate the height reached by the vehicle.

Figure 3:
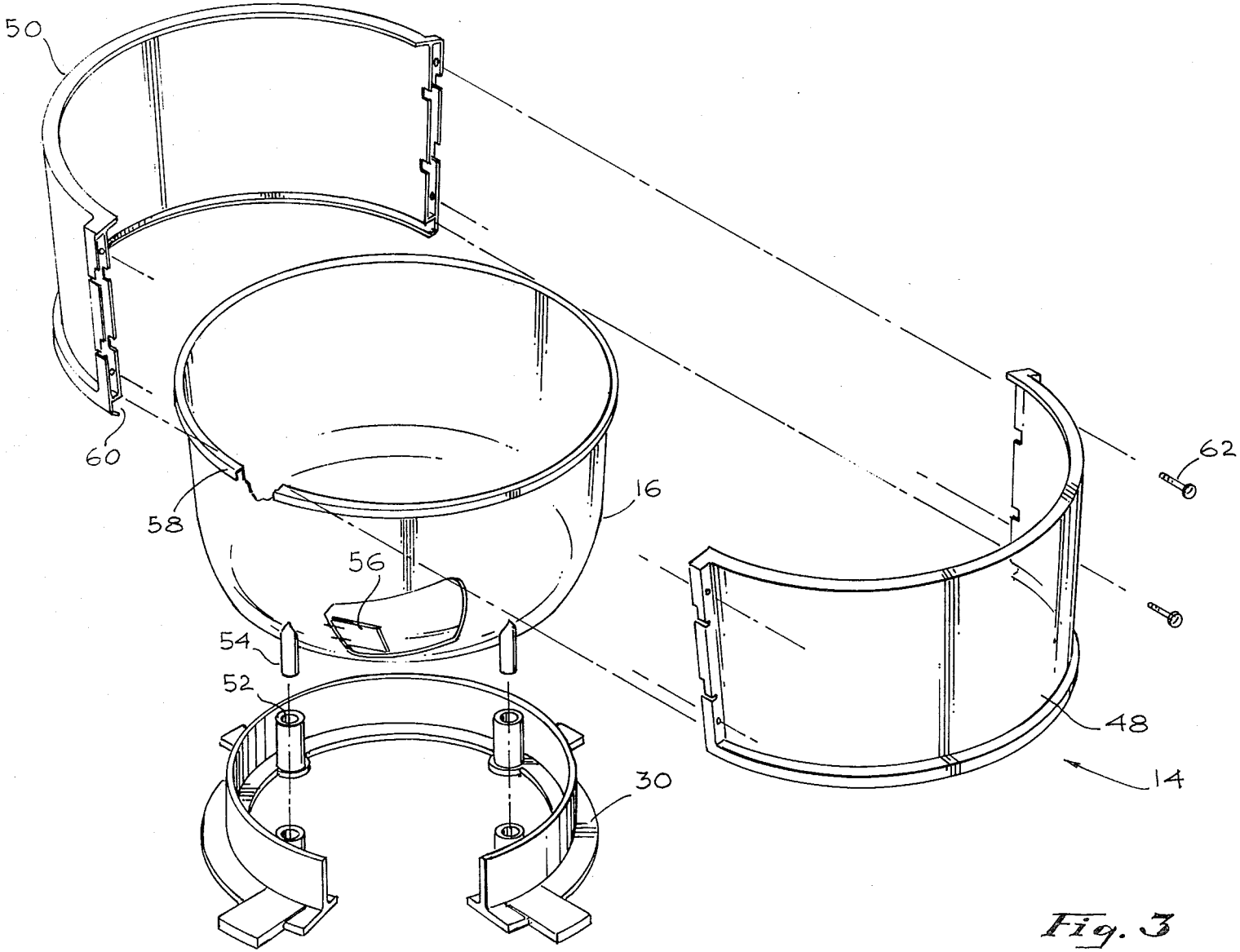
FIG. 3 is an exploded perspective view showing the details of construction of the invention shown in FIG. 1.

The details of construction of the drum 12 are shown in the exploded perspective view of FIG. 3. This view illustrates the upper section 14 which is constructed of two matching sections 48 and 50, the lower section 16, and the base 30. Each of these portions of the drum 12 may be molded by well-known techniques from various plastic materials which are well known in the art. As explained above, in a preferred embodiment, the sections 14 and 16 are constructed of a transparent material to lend additional excitement to the toy. The base 30 is provided with four sockets 52 which are adapted to mate with four legs 54 molded into the lower section 16. The lower section 16 has a projection 56 which is adapted to fit into a slot (not shown) in a particular type of commercially available flexible track so that the track 18 will have its running surface tangent to the inner wall of the lower section 16. Obviously, other types of fittings could be used in place of the projection 56. The upper section 14 fits tightly to the lower section 16 by clamping inwardly about an upper outwardly projecting rim 58 on the lower section 16. Each of the sections 48 and 50 has an inwardly projecting ridge 60 which provides a cavity in which the rim 58 fits as the two sections 48 and 50 are clamped together. The sections 48 and 50 may be held together by means such as screws 62.

In a preferred embodiment, the drum 12 has an inner height of approximately 11½ inches between its base and the upper rim 34. The inner diameter of the upper section 14 at its maximum is approximately 11 inches. The minimum inner diameter of the upper section 14 and the maximum inner diameter of the lower section 16 where they mate is appproximately 10¼ inches and the diameter of the horizontal flat portion of the base of the section 16 is approximately 9 inches. The walls of the sections 14 and 16 are by those dimensions given approximately a 6 degree slope inwardly from the vertical over substantially all of the interior height of the drum 12. The interior is, however, gently rounded from flat base of section 16 which has a 9 inch diameter into the inner walls of the lower section 16 to provide a smooth transition for vehicles 22 progressing on their upper spiral path Obviously, other materials and construction techniques could be used to provide a toy racing track such as that described herein. Moreover, battery or spring powered cars might be used with the toy racing track without departing from the concept. Furthermore, various changes might be made in the form of the toy racing track while retaining and inventive concepts. Thus, while there has been shown and described a preferred embodiment, it is to be understood that various other adaptations and modifications may be made which fall within the spirit and scope of the invention.

What is claimed is:

1. A toy racing apparatus comprising an inclined section of track; a bowl having an opening in the lower portion thereof; means for forming a smooth surface joining the track to the bowl, the surface joining the bowl at the opening in a plane tangent to the inner surface of the bowl; and means for indicating the height to which a vehicle progresses within the bowl, including a flag mounted on the exterior of the bowl, and means projecting into the interior of the bowl to displace the flag as the vehicle passes the height of the flag.

* * * * *